US008993932B2

(12) United States Patent
Mammoli

(10) Patent No.: US 8,993,932 B2
(45) Date of Patent: Mar. 31, 2015

(54) ROTARY DRIER FOR PLANTS FOR THE PRODUCTION OF BITUMINOUS MACADAMS WITH THE USE OF RECYCLED MATERIALS

(75) Inventor: Fabio Mammoli, Bussolengo (IT)

(73) Assignee: Ammann Italy S.p.A., Bussolengo (IT)

( * ) Notice: Subject to any disclaimer, the term of this patent is extended or adjusted under 35 U.S.C. 154(b) by 661 days.

(21) Appl. No.: 13/379,208

(22) PCT Filed: Jul. 5, 2010

(86) PCT No.: PCT/IB2010/053078

§ 371 (c)(1),
(2), (4) Date: Feb. 14, 2012

(87) PCT Pub. No.: WO2011/004314

PCT Pub. Date: Jan. 13, 2011

(65) Prior Publication Data

US 2012/0132641 A1 May 31, 2012

(30) Foreign Application Priority Data

Jul. 9, 2009 (EP) ..... 09425275

(51) Int. Cl.
*F27B 7/00* (2006.01)
*E01C 19/10* (2006.01)

(52) U.S. Cl.
CPC ..... *E01C 19/1036* (2013.01); *E01C 2019/1095* (2013.01); *E01C 2019/109* (2013.01)
USPC ..... 219/389

(58) Field of Classification Search
USPC ..... 366/5, 25; 219/389
See application file for complete search history.

(56) References Cited

U.S. PATENT DOCUMENTS 4,174,181 A * 11/1979 Garbelman et al. ..... 366/2
4,427,376 A * 1/1984 Etnyre et al. ..... 432/105
5,083,870 A * 1/1992 Sindelar et al. ..... 366/25
5,520,342 A * 5/1996 Hendrickson et al. ..... 241/67
5,664,882 A * 9/1997 Green et al. ..... 366/25

(Continued)

FOREIGN PATENT DOCUMENTS

CN 1380920 A 11/2002
DE 34 23 521 A1 1/1986

(Continued)

*Primary Examiner* — Dana Ross
*Assistant Examiner* — Renee L Miller
(74) *Attorney, Agent, or Firm* — Pearne & Gordon LLP

(57) ABSTRACT

A rotary drier for plants for the production of bituminous macadams with the use of recycled materials comprises a hollow rotary cylinder (2), heating means (9) connected to one end (4) of the cylinder (2), an aggregates infeed section (7) connected to one end (3), (4) of the cylinder (2), and a dried material outfeed section (8) connected to the other end (3), (4), an insertion section (24) for inserting recycled material into the cylinder (2), the insertion section being connected to an intermediate portion of the cylinder (2). The inside of the cylinder (2) is axially divided into a first, convection heat exchange zone (12), equipped with material tipping blades (14), and into a second, radiation and conduction heat exchange zone, and the cut material insertion section (24) is positioned inside the first heat exchange zone (12). A first group (25) of tipping blades (14) is mounted circumferentially inside the cylinder (2) between the insertion section (24) and the second heat exchange zone (13).

7 Claims, 8 Drawing Sheets

(56) References Cited

U.S. PATENT DOCUMENTS

| | | | | |
|---|---|---|---|---|
| 5,794,865 | A * | 8/1998 | Didion et al. | 241/74 |
| 5,904,904 | A * | 5/1999 | Swanson | 422/182 |
| 7,357,562 | B2 * | 4/2008 | Hawkins | 366/23 |
| 7,581,871 | B2 * | 9/2009 | Hawkins | 366/7 |

FOREIGN PATENT DOCUMENTS

| | | | |
|---|---|---|---|
| EP | 0 562 234 | A1 | 9/1993 |
| EP | 1 624 109 | B1 | 4/2009 |
| SU | 436912 | A1 | 7/1974 |

* cited by examiner

ROTARY DRIER FOR PLANTS FOR THE PRODUCTION OF BITUMINOUS MACADAMS WITH THE USE OF RECYCLED MATERIALS

FIELD OF THE INVENTION

The present invention relates to a rotary drier for plants for the production of bituminous macadams with the use of recycled materials.

BACKGROUND OF THE INVENTION

It is a type of drier which comprises a hollow rotary cylinder which at least in operation is angled so that its ends are at different heights relative to the ground. In general, the angle of the axis is approximately several degrees relative to the horizontal.

Connected to one end of the cylinder there are heating means normally consisting of a burner which generates a flame that extends inside the cylinder.

The combustion fumes then pass through the rest of the cylinder and reach a chimney, usually connected to the end of the cylinder opposite the end connected to the burner.

Also connected to the two ends of the cylinder there is an infeed section through which the aggregates to be dried are inserted, and an outfeed section through which the treated materials are extracted from the cylinder.

Depending whether the infeed section is connected to the end to which the burner is connected or to the other end, the drier is referred to as cocurrent (since the direction of feed of the fumes and of the material is the same) or counter-current (since the direction of feed of the materials is opposite to that of the fumes).

However, irrespective of the type of drier, the infeed section is always connected to the cylinder at the end which in operation is higher above the ground, so that the combined effect of cylinder rotation and angling causes the material to be fed through the cylinder.

Inside the cylinder there are usually many series of blades designed to mix and feed the material being processed as well as to facilitate heat exchange.

In particular, the blades intended only for feed can adopt a very spiral shape relative to the axis of rotation, whilst those also intended for mixing and/or heat exchange normally extend at least mainly parallel with the axis of rotation.

Depending on their structure, the blades for mixing and/or heat exchange may generally be divided into tipping blades and containment blades. The former are blades characterised in that they have a mouth for the material whose width is significantly greater than the depth of the blade (understood to be the distance between the edge of the blade and its innermost point) as well as a profile which prevents the formation of undercuts. Said blades are designed to collect the material as they pass in the lower rotation zone and to pour it out so that it showers through the combustion fumes passing through the central part of the cylinder.

With a suitable construction it is possible to unload more than 80% of the material contained in the tipping blades practically just after they have reached the highest point of the rotation (only at that moment is their mouth facing downwards). In contrast, the containment blades are blades in which the width of the mouth is generally comparable (the same as or slightly less than/greater than) the depth and they have a rounded profile forming an undercut able to retain the material. These blades are designed to minimise the quantity of material unloaded to shower through the combustion fumes. With the shape described above it is possible to ensure that during rotation they pass the highest point having unloaded even less than 20% of the material initially loaded.

The inside of the cylinder is axially divided, starting at the first end, into a first heat exchange zone, in which heat exchange occurs mainly by convection, and a second heat exchange zone, in which heat exchange occurs mainly by radiation and conduction. The different heat exchange is achieved by using tipping blades in the first heat exchange zone where the temperature of the fumes is lower, and containment blades in the second heat exchange zone where the temperature is significantly higher due to the presence of the flame.

As regards recycled materials, plants for the production of bituminous macadams usually use materials obtained from cutting existing road surfaces, which are normally mixed with new aggregates in predetermined proportions.

For that reason, the driers for which the present invention is intended comprise an insertion section for inserting recycled material into the cylinder, the insertion section being connected to an intermediate portion of the cylinder. In particular, the insertion section may or may not be connected to the cylinder at a change in its diameter.

According to the prior art, the insertion section is positioned between the first and second heat exchange zones, so that the recycled materials are subjected to heating mainly by conduction and radiation.

Also according to the prior art, the insertion section comprises one or more radial openings made in the wall of the cylinder and a feeder for directing the recycled material to the openings from the outside. Inside the cylinder, there may be a tubular structure coaxial with the cylinder and designed to prevent the entering recycled material from passing directly through the combustion fumes, diverting it at a tangent along the lateral wall of the cylinder (see for example patent EP 1 624 109).

However, all types of prior art driers (whether of the counter-current or co-current type) have disadvantages.

In particular, all prior art plants have limits regarding the possibility of using recycled material. Above predetermined limits of approximately 15-20%, the bitumen contained in the recycled material usually causes the material to become packed together, attaching to the blades and the cylinder.

A second disadvantage of prior art plants is the fact that they cannot guarantee good mixing of the hot aggregates and the cold cut material which is added, meaning that the temperature distribution is very uneven in the cut material, causing the formation of emissions which are harmful to the environment.

SUMMARY OF THE INVENTION

In this situation the technical purpose which forms the basis of the present invention is to provide a rotary drier for plants for the production of bituminous macadams with the use of recycled materials which overcomes the above-mentioned disadvantages.

In particular, the technical purpose of the present invention is to provide a rotary drier for plants for the production of bituminous macadams which allows the use of a greater quantity of recycled material than prior art plants.

The present invention also has for a technical purpose to provide a rotary drier for plants for the production of bituminous macadams which guarantees mixing of the hot aggregates and cold recycled materials that is better than the mixing in prior art plants.

Yet another technical purpose of the present invention is to provide a rotary drier for plants for the production of bituminous macadams which guarantees compliance with environmental impact regulations, that is to say, which minimises the formation of harmful emissions.

The technical purpose specified and the aims indicated are substantially achieved by a rotary drier for plants for the production of bituminous macadams with the use of recycled materials as described in the appended claims.

BRIEF DESCRIPTION OF THE DRAWINGS

Further features and the advantages of the present invention are more apparent in the detailed description a preferred, non-limiting embodiment of a rotary drier for plants for the production of bituminous macadams with the use of recycled materials illustrated in the accompanying drawings, in which.

DETAILED DESCRIPTION OF PREFERRED EMBODIMENTS OF THE INVENTION

Figure 1:
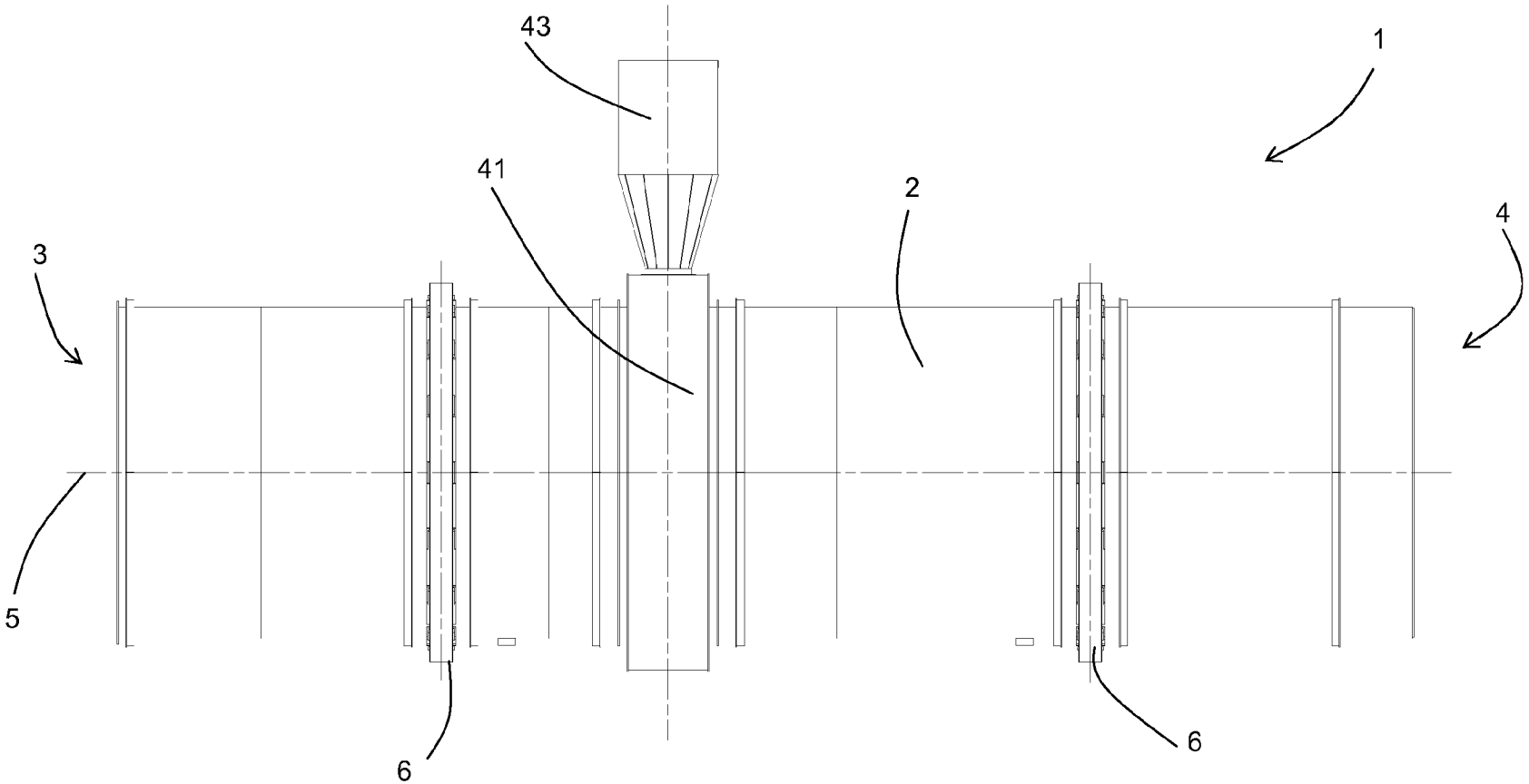
FIG. 1 is a side view of a drier made in accordance with the present invention.

With reference to the accompanying drawings the numeral 1 denotes as a whole a rotary drier for plants for the production of bituminous macadams with the use of recycled materials, made according to the present invention.

In the known way, the drier 1 comprises first a hollow rotary cylinder 2 which has a first end 3, a second end 4 and an axis of rotation 5 extending from the first end 3 to the second end 4. Although not illustrated in the accompanying drawings, at least in operation the axis of rotation 5 is angled so that the first end 3 and the second end 4 are at different heights above the ground. Advantageously, the angle of the axis is approximately several degrees (usually between 2° and 6°) relative to the horizontal, so that the cylinder 2 is practically reclined.

Figure 6:
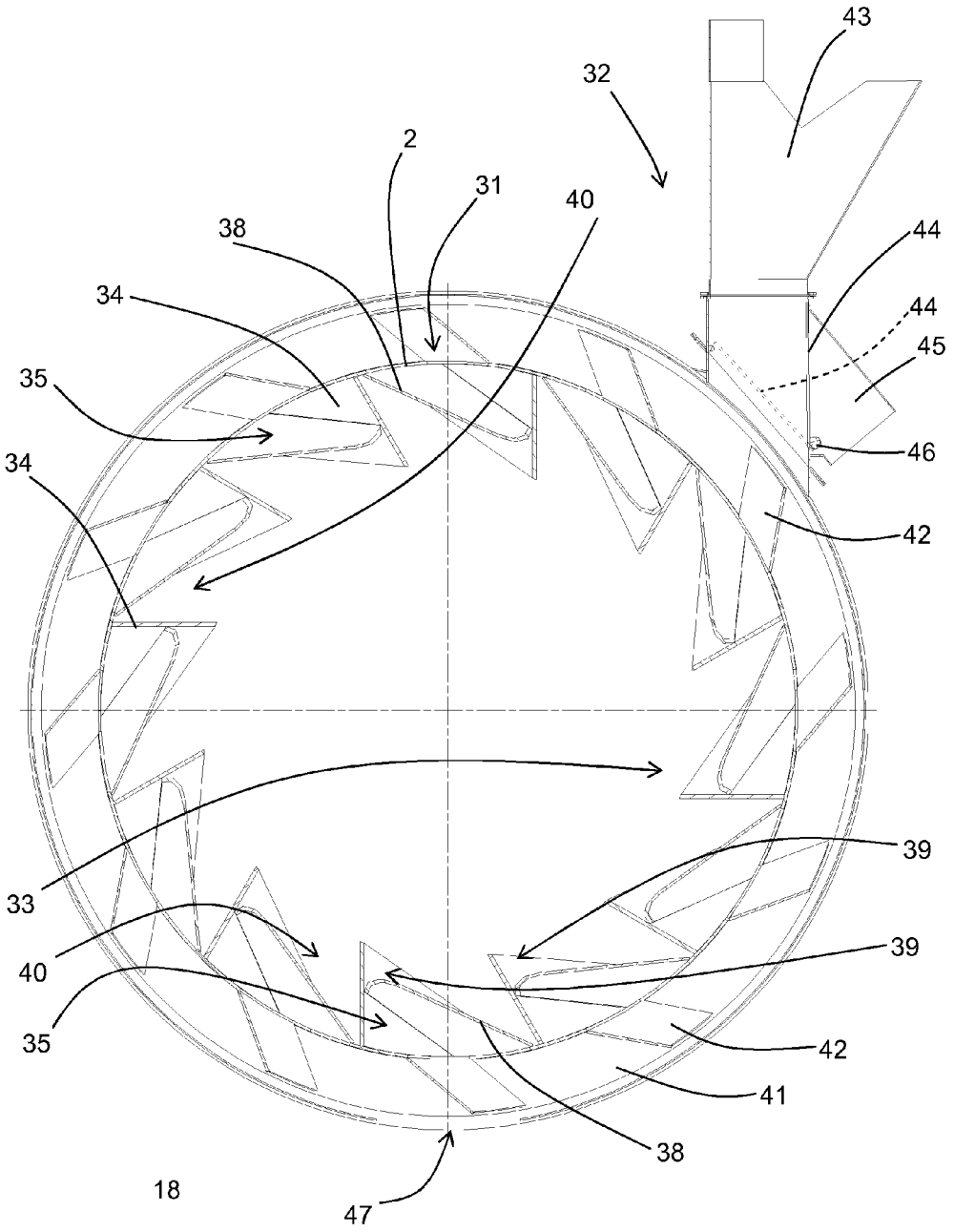
FIG. 6 is a cross-section of the drier of FIG. 1 according to the line VI-VI, with some background details cut away for clarity.

Moreover, the cylinder 2 has a predetermined direction of rotation which in the embodiment illustrated is anti-clockwise with reference to FIG. 6. Cylinder 2 rotation is made possible by two supporting rings 6 which have bearings inside them, rings 6 which in practice are supported by a plant frame. Cylinder 2 rotation is driven by suitable motor-driven means of the known type (not illustrated).

Depending on the embodiments, the cylinder 2 may comprise a single body with a constant diameter along the entire length (as illustrated in the accompanying drawings) or two or more bodies which are axially aligned and have the same or different diameters. The cylinder 2 also has an aggregates infeed section 7 connected to the cylinder 2 at the end 3, 4 which in operation is highest above the ground, and a dried material outfeed section 8 connected to the cylinder 2 at the other end 3, 4.

In the accompanying drawings, in which the drier 1 is of the counter-current type, the infeed section 7 is connected to the first end 3, whilst the outfeed section 8 is connected to the second end 4.

Consequently, the embodiment illustrated in operation has the first end 3 higher than the second end 4.

In general, in the cylinder 2 a material feed direction is always identified, going from the infeed section 7 to the outfeed section 8.

In the accompanying drawings, the infeed section 7 and the outfeed section 8 are not shown in detail since they generally comprise in the known way inlets and outlets at or close to the two ends of the cylinder 2.

Figure 8:
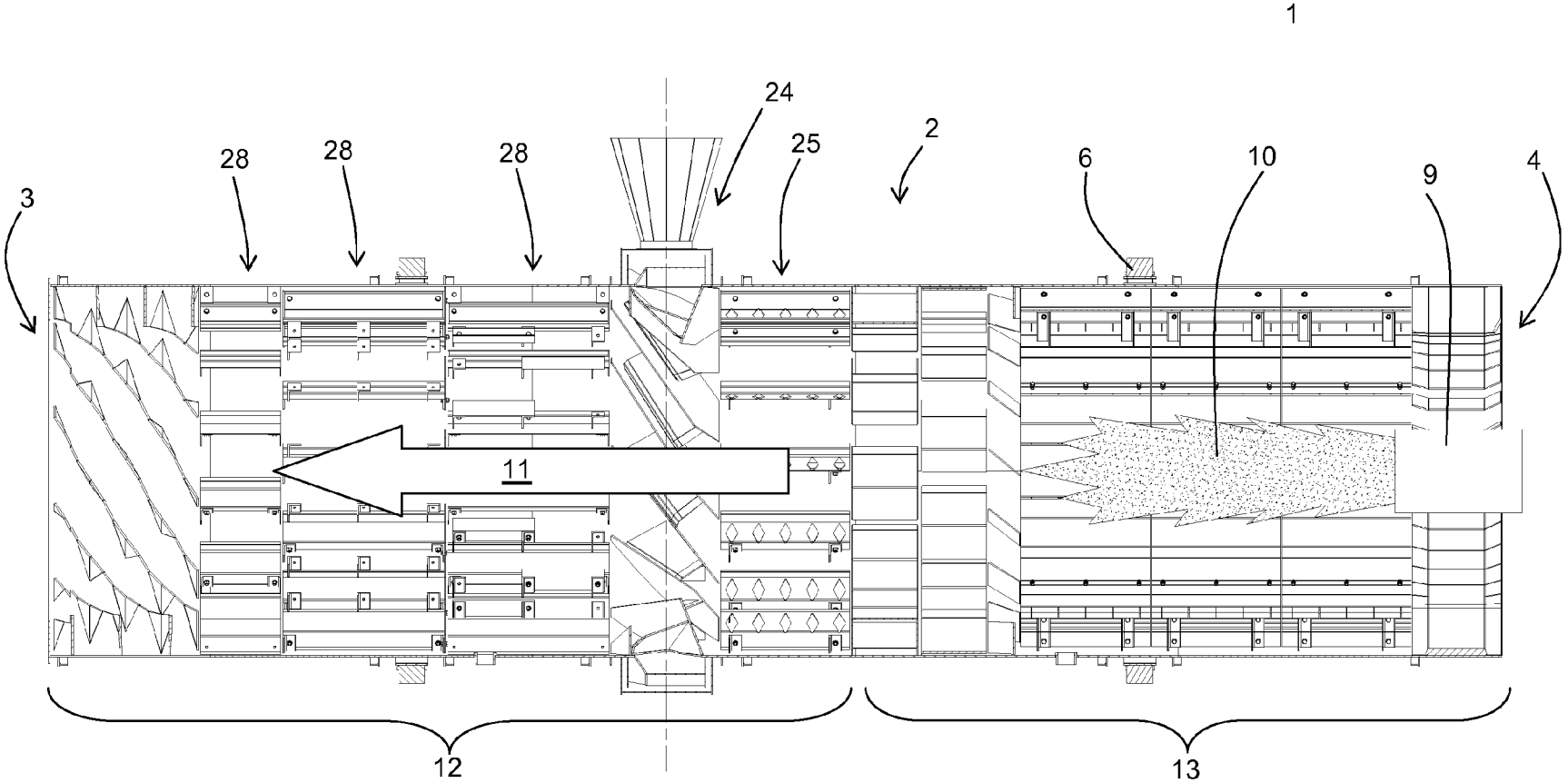
FIG. 8 illustrates the drier of FIG. 2, showing the heating means 9.

Connected to the second end 4 of the cylinder 2 there are heating means 9 (only visible in FIG. 8) preferably consisting of a burner. FIG. 8 schematically illustrates both the flame 10 produced by the burner and the direction 11 of flow of the fumes. The latter move from the burner towards a chimney (not illustrated) connected to the first end 3 of the cylinder 2.

The inside of the cylinder 2 is axially divided, starting at the first end 3, into a first heat exchange zone 12, in which heat exchange occurs mainly by convection, and a second heat exchange zone 13, in which heat exchange occurs mainly by radiation and conduction. In particular, the first heat exchange zone 12 is advantageously made in such a way that it creates a shower of material through the combustion fumes, whilst the second heat exchange zone 13 is made in such a way that it prevents, or at least minimises, interference between the material and the flame 10 (and therefore material showering down).

The first heat exchange zone 12 is equipped with a plurality of material tipping blades 14, whilst in the embodiment illustrated the second heat exchange zone 13 is equipped with a plurality of material containment blades 15. The terms tipping blades 14 and containment blades 15 refer to blades of the known type able to respectively maximise and minimise the showering of material inside the cylinder 2. Advantageously, in general they may adopt the known shape indicated at the start of this description.

In particular, the tipping blades 14 preferably mainly consist of at least one shaped element 16 (advantageously metal) extending along the cylinder 2 inner surface 18 and having a first longitudinal edge 17 (the term longitudinal being understood with reference to the direction of extension of the axis of rotation 5) abutted to the cylinder 2 inner surface 18 and a second longitudinal edge 19 distanced from the cylinder 2 inner surface 18, forming the blade mouth. The shaped element 16 also has two lateral edges 20 (transversal to the longitudinal direction) respectively facing towards the first end 3 and towards the second end 4 (depending on the material feed direction, the lateral edges 20 may also be defined as the front edge and the rear edge).

A more detailed description of the various blades used in the embodiment illustrated is provided below.

Moreover, as shown in the accompanying drawings, the first heat exchange zone 12, close to the first end 3, is also equipped with spiral blades 21, close together and shaped, which guarantee correct insertion of the aggregates in the cylinder 2, whilst the second heat exchange zone 13 is also equipped, in the zone which in practice surrounds the flame 10, with a tubular protective structure 22 coaxial with the cylinder 2, also shaped, but which is not part of the present invention.

Although not visible, there are blades on the inner surface 18 of the cylinder 2 even at the tubular protective structure 22. Finally, at the burner, the second heat exchange zone 13 is equipped with other shaped blades 23 mainly radial and longitudinal for unloading material to the outfeed section 8.

The type of drier 1 for which the present invention is intended also comprises an insertion section 24 for inserting cut recycled material in the cylinder 2, the insertion section being connected to an intermediate portion of the cylinder 2.

Figure 2:
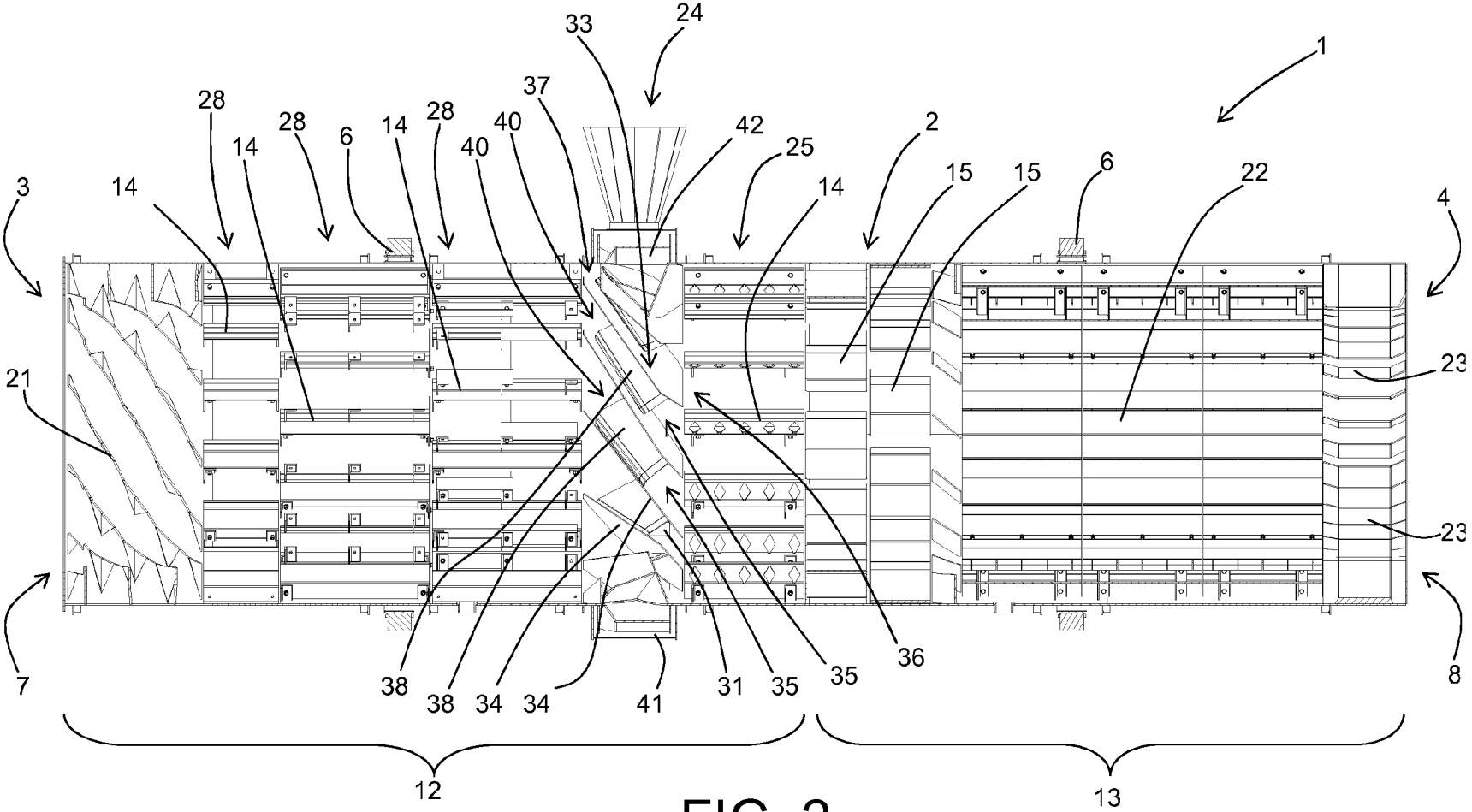
FIG. 2 is a longitudinal axial section of the drier of FIG. 1.
Figure 3:
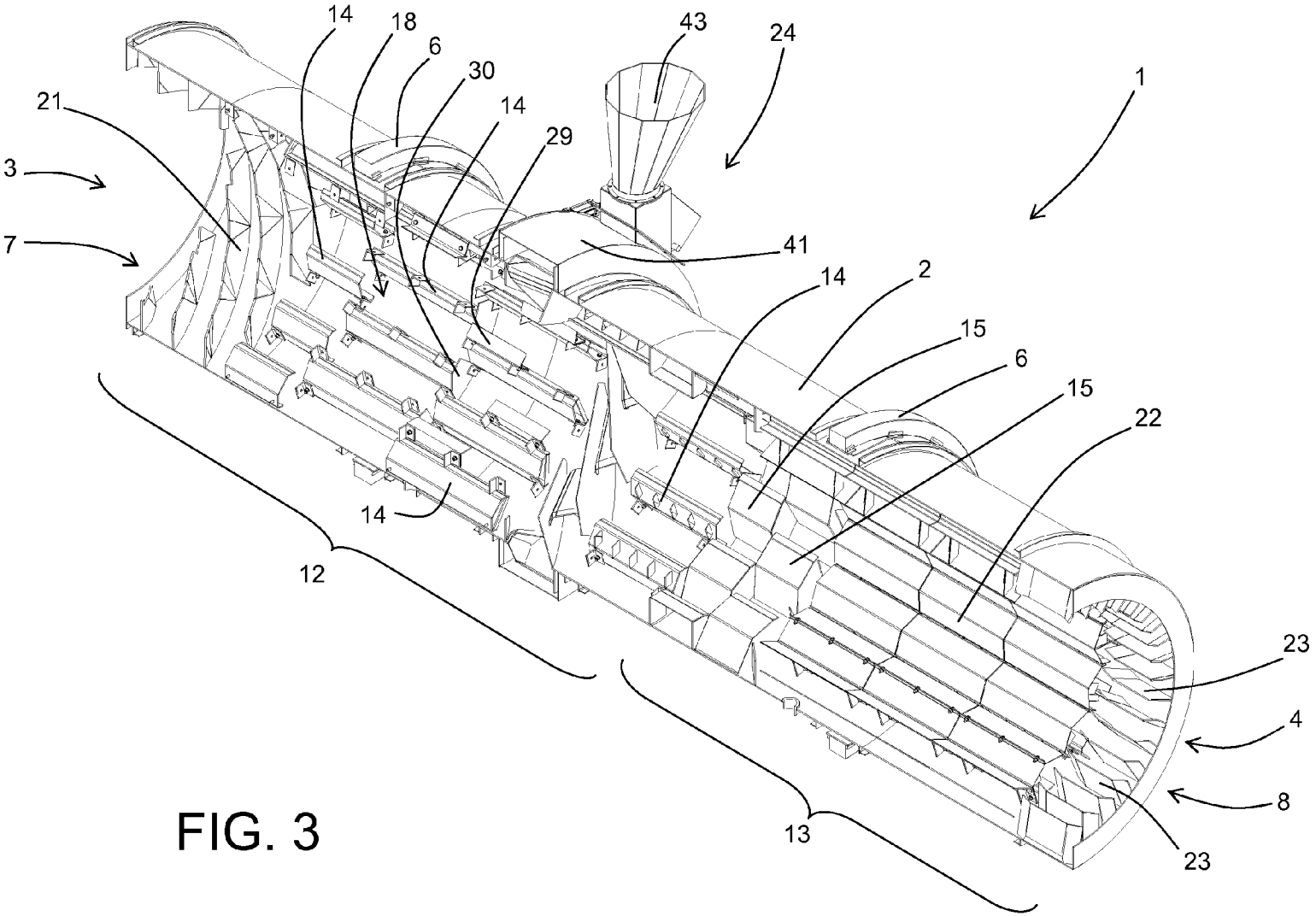
FIG. 3 is an axonometric view of the sectioned drier of FIG. 2.

Whilst in conventional embodiments the insertion section 24 is positioned between the first and second heat exchange zones 12, 13, according to the present invention it is positioned inside the first heat exchange zone 12, as illustrated in FIGS. 2 and 3. Therefore, according to the present invention, at least a first group 25 of material tipping blades 14 is mounted circumferentially inside the cylinder 2 between the insertion section 24 and the second heat exchange zone 13.

In the accompanying drawings the tipping blades 14 of the first group 25 are all identical, are mounted inside the cylinder 2 in such a way that they are all in the same position relative to the cylinder 2 axial extension (in other words, the tipping blades 14 of the first group 25 form a single ring of blades around the axis of rotation 5), and they are evenly distributed along the circumference of the cylinder 2. In any case, in other embodiments the tipping blades 14 of the first group 25 may be made or arranged differently, for example they may have different shapes and/or dimensions, or they may be divided into two or more rings of blades, or they may be positioned so that they are axially offset, etc.

In the case of a counter-current drier 1, the presence of the tipping blades 14 downstream of the insertion section 24 allows both improved heating of the recycled cut material compared with prior art plants, and above all improved mixing of the hot aggregates and cold cut material, reducing the temperature gradients within the material being processed compared with prior art driers.

In the embodiment illustrated, the tipping blades 14 of the first group 25 comprise a shaped element 16, bolted to suitable L-shaped elements 26 welded to the cylinder 2 inner surface 18 (FIG. 5—notice that in all of the accompanying drawings the welded connections between the various parts are not illustrated), and whose lateral edges 20 are open.

Moreover, advantageously, the tipping blades 14 of the first group 25 are provided with a plurality of through-holes 27 designed to allow part of the material being processed to pass, in the embodiment illustrated having the shape of a rhombus. Thanks to the through-holes 27, during the first step of the rotation (ascending step) part of the material gathered by each tipping blade 14 falls downwards, mixing and being collected by the next tipping blade 14. In this way, in some applications it is possible to further improve mixing of the aggregates and the recycled materials.

However, depending on requirements, some or all of the tipping blades 14 of the first group 25 may even be made without through-holes 27, having a solid shaped element 16. In said case, the disadvantage of reduced mixing than occurs with pierced tipping blades 14 may be compensated for by the advantage of an increase in the thermal yield of the plant thanks to heating of all of the material by convection.

In other words, the tipping blades 14 of the first group 25 may also be made with a structure like that of the tipping blades 14 located on the other side of the insertion section 24.

As FIGS. 2 and 3 reveal, in the embodiment illustrated the tipping blades 14 located between the first end 3 and the insertion section 24 are grouped in three successive rings 28 of blades radially offset from each other. Moreover, all of the blades are made with shaped elements having a practically identical profile but different length, bolted on suitable L-shaped elements 26 which are welded to the cylinder 2.

Figure 5:
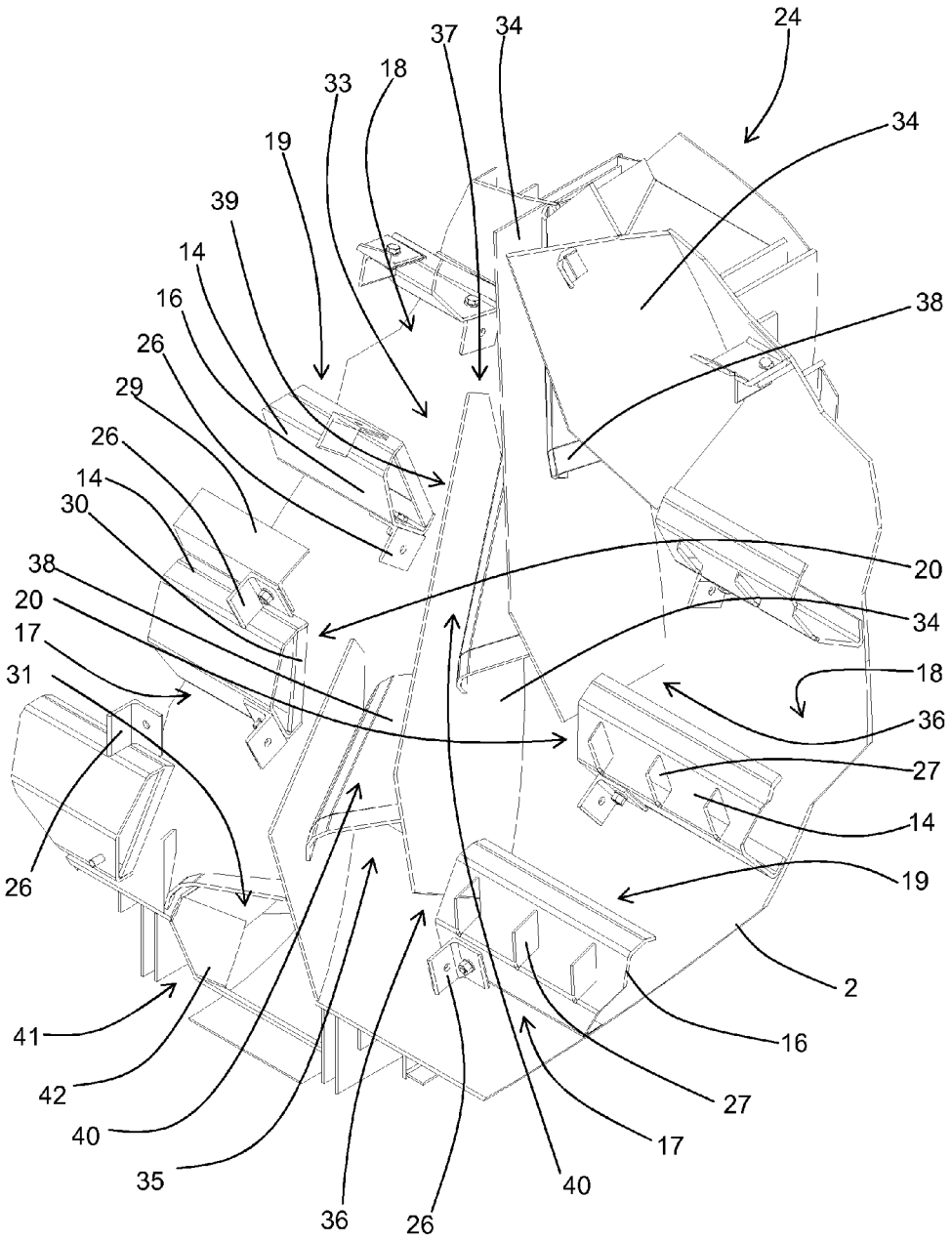
FIG. 5 shows another detail of the drier of FIG. 3.

Each tipping blade 14 of the two rings 28 of blades closest to the infeed section 7 has, welded to the shaped element 16 at the second longitudinal edge 19, a plurality of other L-shaped elements 26 designed to support sections 29, also L-shaped, which locally increase the capacity of the tipping blade 14. As FIGS. 3 and 5 show, the length of the L-shaped sections 29 is approximately half the length of the respective tipping blade 14 and they are alternately fastened to the portion of the blade 14 towards the first end 3 and to the portion of the blade 14 towards the second end 4.

In other embodiments, not illustrated, the drier 1 may comprise a second group of tipping blades 14 mounted circumferentially inside the cylinder 2 close to the insertion section 24 and on one side of it towards the first end 3. At least some of the tipping blades 14 of the second group are provided with a plurality of through-holes 27 designed to allow part of the material being processed to pass through, like those described above for the tipping blades 14 of the first group 25.

Depending on requirements, the drier 1 may also comprise means 30 for slowing material feed from the infeed section 7 towards the outfeed section 8.

In the embodiment illustrated, said slowing means 30 comprise a plurality of closing partitions fastened to the lateral edge 20, facing towards the outfeed section 8, of the shaped element 16 of a plurality of both tipping 14 and containment 15 blades. The closing partitions may close the lateral edge 10 of the shaped element 16 either completely (like those connected to the containment blades 14 of the intermediate ring 28—FIG. 3), or only partly (like those connected to the lateral edge 20 of the ring 28 of tipping blades upstream of the insertion section 24 in the accompanying drawings—FIG. 5). In contrast, in other embodiments not illustrated, the slowing means 30 may comprise one or more annular partitions extending transversally relative to the axis of rotation 5, mounted on the cylinder 2 inner surface 18.

The present invention may be applied irrespective of the shape of the recycled materials insertion section 24.

However, the cut material insertion section 24 preferably comprises at least one radial opening 31 made through the cylinder 2 lateral wall, as well as, on the outside of the cylinder 2, means 32 for feeding the cut material to the openings 31.

Advantageously, the insertion section 24 also comprises at least one structure 33 covering the opening 31, fastened to the cylinder 2 inner surface 18 upstream of the opening 31 relative to the material feed direction, extending in the feed direction and distanced from the cylinder 2 inner surface 18 downstream of the opening 31 (again relative to the feed direction). In this way, the opening 31 is put in communication with the inside of the cylinder 2 but at the same time the covering structure 33 protects the opening 31 from the aggregates arriving. Consequently, mixing of the aggregates with the recycled material only takes place downstream of the covering structure 33.

In a first embodiment, not illustrated, the opening 31 is annular and extends around the entire circumference of the cylinder 2. The covering structure 33 is also annular.

However, in the preferred embodiments the insertion section 24 comprises a plurality of radial openings 31 distributed circumferentially on the cylinder 2 inner surface 18 and covered by the covering structure 33. Whilst in FIG. 7 the openings 31 are independent of each other, in other embodiments they may be obtained by making a single annular opening 31, extending around the entire circumference of the cylinder 2, and partly covering it (for example from the inside of the cylinder 2) to form the individual openings 31.

In the embodiment illustrated, the covering structure 33 comprises a plurality of separator plates 34 distributed circumferentially along the cylinder 2 inner surface 18 so that between each pair of adjacent separator plates 34 there is at least one radial opening 31. Advantageously, the separator plates 34 are made in such a way that they form a plurality of first channels 35 for guided insertion of the cut material into the cylinder 2. It should be noticed that the separator plates 34 may also be used to divide from the inside a single annular opening 31 into a plurality of openings 31 as indicated above.

As shown in FIG. 5, in the preferred embodiment, the separator plates 34 extend radially relative to the axis of rotation 5 along spiral trajectories centred on the axis of rotation 5. They also have a first end side 36 towards the outfeed section 8 and a second end side 37 towards the in feed section 7, and they are advantageously positioned so that during cylinder 2 rotation the second end side 37 of each separator plate 34 angularly precedes the first end side 36 of the same separator plate 34 (in other words, they are positioned so that the first channels 35 which they form are angled towards the outfeed section 8 during the ascending part of the rotation).

Moreover, in the embodiment illustrated, the covering structure 33 comprises covering partitions 38 mounted over the openings 31, distanced from them, and connected to the separator panels 34.

Advantageously, the covering structure 33 is also equipped with guide and feed elements 39 for the material arriving from the infeed section 7 which form second channels 40 designed to guide the material arriving from the infeed section 7 until it is mixed with the recycled material. In the embodiment illustrated the guide and feed elements 39 for the aggregates are formed by the separator plates 34 projecting upwards relative to the covering partitions 38.

The cut material feed means 32, in the embodiment illustrated (FIGS. 5 and 6) comprise first an annular chamber 41 made around the outside of the cylinder 2 at the insertion section 24. A plurality of scoops 42 extends inside the annular chamber 41 from the outside of the cylinder 2 and is circumferentially distributed along the cylinder 2 outer surface so that between each pair of adjacent scoops 42 there is an opening 31 (in FIG. 7 the scoops 42 are cut away for clarity). A duct 43 for feeding the cut material to the annular chamber 41 opens into the annular chamber 41 to feed the material at a side of the cylinder 2 which during rotation moves upwards (in FIG. 6, to a first approximation, the feed duct 43 outlet into the annular chamber 41 is substantially aligned with the vertical tangent to the outer side of the cylinder 2 which moves upwards during rotation).

Moreover, advantageously, the scoops 42 are angled relative to the cylinder 2 outer surface in the direction of the movement (or, in other words, forwards relative to their movement trajectory).

Figure 4:
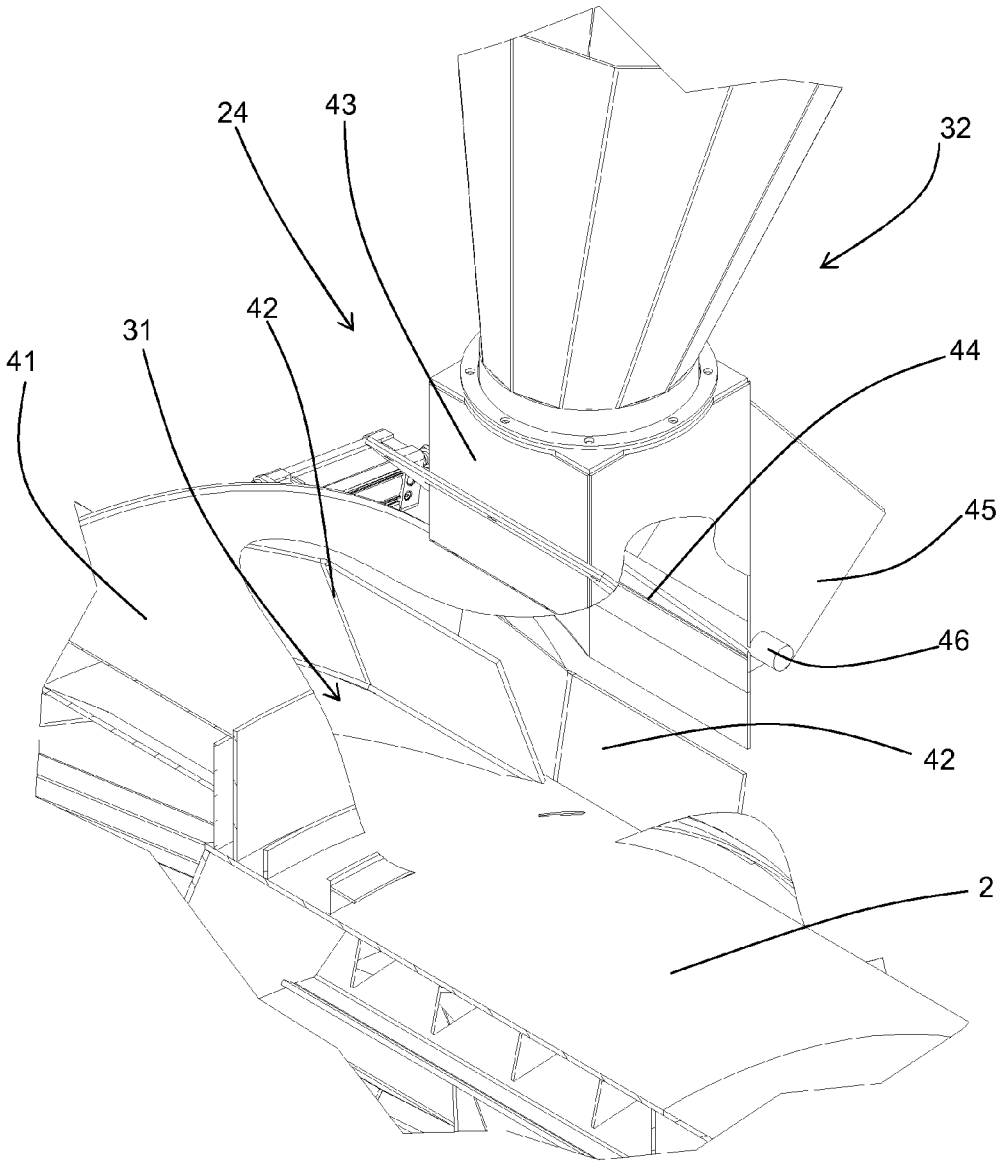
FIG. 4 shows a detail of the drier of FIG. 3 with some parts cut away to better illustrate others.

The feed duct 43 is also equipped with a mobile partition 44 designed to divert the flow of recycled material either into the annular chamber 41 (position shown with a continuous line in FIG. 6) or towards a secondary outlet 45 (position illustrated with a dashed line in FIG. 6 and visible in FIG. 4). In the embodiment illustrated the passage between the two positions takes place by rotation about a hinge 46 fastened to the feed duct 43.

Figure 7:
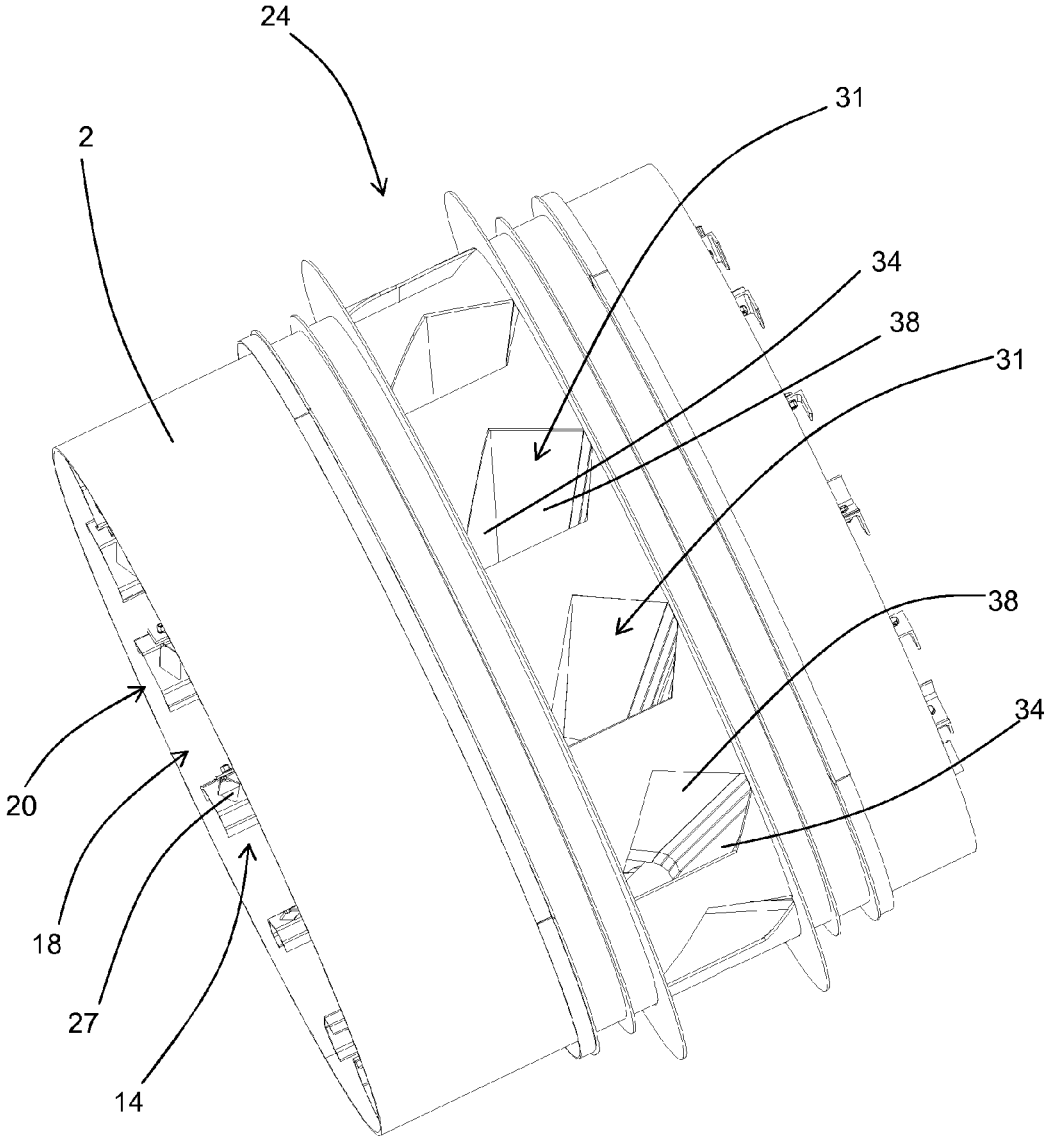
FIG. 7 is an axonometric view from the outside and from the top of an intermediate piece of the drier of FIG. 1 with some parts cut away to better illustrate others (the cylinder is seen from the opposite side to that in FIG. 1)

It should also be noticed that FIG. 7 shows the part of the cylinder 2 to which the insertion section 24 is connected from a viewpoint close to the position of the feed duct 43 and that in said figure the feed means 32 are completely removed.

Drier 1 operation derives directly from what is described above, and is summarised below with reference to the counter-current drier 1 shown in the accompanying drawings. For other types of driers 1 operation is similar with the relevant modifications.

The cylinder 2 is made to rotate with a speed generally variable between 6 and 11 revolutions per minute, and the aggregates are inserted through the infeed section 7. At the same time the burner is supplied with the air-fuel mixture and generates the flame 10 as illustrated in FIG. 8. The fumes generated by combustion then flow along the entire cylinder 2 and are evacuated through the chimney.

The flame 10 temperature usually varies between 1600 and 1300° C. whilst the temperature of the fumes, running regularly, varies approximately between 900 and 150° C. (respectively in the zone close to the flame 10 and at the chimney entrance).

In the accompanying drawings, the spiral blades 21 feed the aggregates from the first end 3 to the tipping blades 14 which collect them and allow them to fall, showering through the combustion fumes, at the same time guaranteeing correct mixing.

Running regularly, the recycled material is inserted in the feed duct 43 and falls onto the scoops 42 of the annular chamber 41, which collect it, during their upward rotation. The combined action of the shape of the scoops 42 and the cylinder 2 rotation causes practically all of the recycled material to penetrate the radial openings 31. Any material which does not enter can in any case be collected by a drain 47 located at the bottom of the annular chamber 41, then be sent back to the feed duct 43.

The recycled material which enters the openings 31 then flows along the first feed channels 35 formed by the separator plates 34. When it comes out of the first channels 35 it mixes with the aggregates which arrive from above through the respective second guide channels 40 also formed by the separator plates 34.

At this point the mixture of aggregates and recycled materials reaches the tipping blades 14 of the first group 25 which, in the embodiment illustrated, allow part of it fall, showering through the combustion fumes and release part of it through their through-holes 27.

The mixture is then collected by the containment blades 15, then made to pass outside the tubular structure 22 until it reaches the outfeed section 8 where it usually arrives at a temperature of approximately 200° C.

The present invention brings important advantages.

Thanks to the present invention, a rotary drier was provided which allows the use of a greater quantity of recycled material than in prior art plants, since it guarantees improved mixing of the hot aggregates and the cold recycled materials, preventing the bitumen present in the recycled material from becoming packed together and blocking the drier.

This is also possible because the recycled material is better distributed in the aggregates with the additional consequence that the temperature gradient in the material is also limited.

Moreover, consequently, thanks to the present invention it is possible at the same time to minimise if not eliminate the formation of emissions which are harmful to the environment.

It should also be noticed that the present invention is relatively easy to produce and that even the cost linked to implementing the invention is not very high.

The invention described above may be modified and adapted in several ways without thereby departing from the scope of the inventive concept.

Moreover, all details of the invention may be substituted with other technical equivalent elements and in practice all of the materials used, as well as the shapes and dimensions of the various components, may vary according to requirements.

The invention claimed is:

1. A rotary drier for plants for the production of bituminous macadams with the use of recycled materials comprising: a hollow rotary cylinder (2) having a first end (3), a second end (4) and an axis of rotation (5) extending from the first end to the second end (4) and, at least in operation, being angled so that the first end and the second end (4) are at different heights above the ground, the cylinder (2) having a predetermined direction of rotation; heating means (9) connected to the second end (4) of the cylinder (2); an aggregates infeed section (7) connected to the cylinder (2) at the end (3), (4) which in operation is highest above the ground, and a dried material outfeed section (8) connected to the cylinder (2) at the other end (3), (4), inside the cylinder (2) a material feed direction being identified from the infeed section (7) to the outfeed section (8); and an insertion section (24) for inserting cut recycled material into the cylinder (2), the insertion section being connected to an intermediate portion of the cylinder (2); the inside of the cylinder (2) being axially divided, starting at the first end (3), into a first heat exchange zone (12), in which heat exchange occurs mainly by convection, equipped with a plurality of material tipping blades (14), and into a second heat exchange zone (13), in which heat exchange occurs mainly by radiation and conduction; the drier being characterised in that the cut material insertion section (24) is positioned inside the first heat exchange zone (12), and at least a first group (25) of tipping blades (14) is mounted circumferentially inside the cylinder (2) between the insertion section (24) and the second heat exchange zone (13), and in that the drier is a counter-current drier (1) in which the infeed section (7) is connected to the first end (3) of the cylinder (2) and the outfeed section (8) to the second end (4).

2. The drier according to claim 1, characterised in that at least some of the tipping blades (14) of the first group (25) are provided with a plurality of through-holes (27) designed to allow part of the material being processed to pass through them.

3. The drier according to claim 1, characterised in that it also comprises a second group of tipping blades (14) mounted circumferentially inside the cylinder (2) close to the insertion section (24) and to one side of it opposite the side towards the second heat exchange zone (13), at least some of the tipping blades (14) of the second group being provided with a plurality of through-holes (27) designed to allow part of the material being processed to pass through them.

4. The drier according to claim 1, characterised in that the tipping blades (14) mainly comprise at least one shaped element (16) extending along the cylinder (2) inner surface (18) and having a first longitudinal edge (17) abutted to the cylinder (2) inner surface (18) and a second longitudinal edge (19) which is distanced from the cylinder (2) inner surface (18), forming a blade mouth, the shaped element (16) also having two lateral edges (20) respectively facing towards the first end (3) and towards the second end (4).

5. The drier according to claim 1, characterised in that it also comprises means (30) for slowing material feed from the infeed section (7) towards the outfeed section (8).

6. The drier according to claim 5, characterised in that the slowing means (30) comprise one or more annular partitions mounted on the cylinder (2) inner surface (18).

7. The drier according to claim 4, characterised in that it also comprises means (30) for slowing material feed from the infeed section (7) towards the outfeed section (8) and in that the slowing means (30) comprise a plurality of closing partitions fastened to the lateral edge, facing towards the outfeed section (8), of the shaped element (16) of a plurality of tipping blades (14).

* * * * *